US007222777B2

(12) United States Patent
Garnier

(10) Patent No.: US 7,222,777 B2
(45) Date of Patent: May 29, 2007

(54) ARTICLE CARRIER HAVING AUTOMATIC END RETENTION MEANS

(75) Inventor: Jean-Michel Garnier, Issoudun (FR)

(73) Assignee: MeadWestvaco Packaging Systems, LLC, Glen Allen, VA (US)

( * ) Notice: Subject to any disclaimer, the term of this patent is extended or adjusted under 35 U.S.C. 154(b) by 0 days.

(21) Appl. No.: 10/490,063

(22) PCT Filed: Sep. 18, 2002

(86) PCT No.: PCT/US02/29589

§ 371 (c)(1),
(2), (4) Date: Aug. 16, 2004

(87) PCT Pub. No.: WO03/024833

PCT Pub. Date: Mar. 27, 2003

(65) Prior Publication Data

US 2005/0001020 A1 Jan. 6, 2005

Related U.S. Application Data

(60) Provisional application No. 60/323,257, filed on Sep. 19, 2001, now abandoned.

(51) Int. Cl.
*B65D 71/36* (2006.01)

(52) U.S. Cl. ..... 229/103.2; 206/427

(58) Field of Classification Search ..... 229/103.2; 206/140, 427, 434

See application file for complete search history.

(56) References Cited

U.S. PATENT DOCUMENTS 2,929,497 A * 3/1960 De Million-Czarnecki . 206/427
2,936,069 A * 5/1960 Dunning ..... 206/427
3,167,214 A * 1/1965 Mahon ..... 229/241
3,679,121 A 7/1972 Morgese
3,963,121 A 6/1976 Kipp
4,077,095 A 3/1978 Oliff
4,215,781 A * 8/1980 Humphries et al. ..... 206/434
4,243,143 A 1/1981 Muller
5,000,313 A * 3/1991 Oliff ..... 206/140
5,060,792 A 10/1991 Oliff
5,131,588 A 7/1992 Oliff
5,180,054 A 1/1993 Bakx
5,195,676 A * 3/1993 LeBras ..... 206/427
5,297,673 A 3/1994 Sutherland
5,311,984 A 5/1994 Harris
5,351,878 A 10/1994 Cooper
5,597,071 A 1/1997 Sutherland
5,605,228 A * 2/1997 Baxter ..... 206/427
5,682,995 A * 11/1997 Sutherland ..... 206/140
5,853,088 A * 12/1998 Saulas et al. ..... 206/427
6,019,220 A * 2/2000 Sutherland ..... 206/427
6,550,616 B2 * 4/2003 Le Bras ..... 206/434

* cited by examiner

*Primary Examiner*—Gary E. Elkins
(74) *Attorney, Agent, or Firm*—Tsugihiko Suzuki

(57) ABSTRACT

The wrap-around carrier of the invention includes opposed side panels hingedly connected to a top panel and to a pair of bottom flaps. An end retention structure is connected to at least one of the side panels and to the adjacent one of the bottom flaps. The end retention structure includes an anchor panel hingedly connected to an end edge of the one side panel and disposed in a face-contacting relationship with the inside surface of the one side panel, a gusset panel hingedly connected to the anchor panel and extending toward the adjacent end opening of the carrier, and an end panel hingedly connected to the gusset panel and disposed to engage the adjacent end article packaged in the carrier to prevent it from dislodging form the carrier. The end retention structure further includes a relief panel that hingedly interconnects the end panel with the one bottom flap. The relief panel is disposed in the plane of the one bottom flap when the carrier is in an erected condition. When the carrier is in blank form, however, the relief panel is capable of folding with respect to the one bottom flap in response to folding of the anchoring panel onto the one side panel.

8 Claims, 4 Drawing Sheets

ARTICLE CARRIER HAVING AUTOMATIC END RETENTION MEANS

This application claims the benefit of Provisional Application No. 60/323,257, filed Sep. 19, 2001.

BACKGROUND OF THE INVENTION

This invention relates generally to wrap-around article carriers formed of paperboard or similarly foldable material, and more particularly to wrap-around carriers which have end retention structures for preventing the end articles from falling out of the carrier.

Wrap-around carriers provide an inexpensive, effective means for packaging articles, requiring blanks of only minimum size which are capable of running on packaging machines at high speeds. A wrap-around carrier is formed by wrapping a carrier blank around a group of articles such as cans, bottles or bricks and securing the ends of the blank together. Although some wrap-around carriers include integral end panels, most are open-ended. The articles are prevented from falling out through the open ends by tightly wrapping the carrier blank around them and also by providing end retention structures at the opposite ends of the carrier. A typical end retention structure consists of an anchor panel connected to an end edge of a carrier side panel, an end panel connected to an end edge of a bottom panel and a gusset panel interconnecting the anchor and end panels. The anchor panel is folded 180 degrees into face-contacting relationship with the inside surface of the associated side panel, which causes the gusset panel to pull the end panel inwardly and to erect the end panel in an upright position where the end panel engages the end article to prevent it from dislodging from the carrier. The anchor panel is held in the folded position due to the pressure of the end bottles against the anchor panel, which, in turn, retains the end panel in the erected upright position.

While such measures have been successful in containing different articles in their wrap-around carriers, there are drawbacks in the carrier forming or erecting process of the aforesaid carriers. Because the folding of the anchor panel induces not only erection of the end panel but also inward folding of the adjacent carrier bottom flap, it is required that the anchoring panel be folded only by the end user of the carrier who applies the carrier blank to a group of articles to be packaged. Such a carrier application or forming process requires use of a special machine elements that engage the anchor panel during the folding step of the adjacent bottom lap panel. The carrier forming process with such machine elements reduces the operating speed of the packaging machine, which affects the machine productivity. Further, the wrap-around carriers with the retention structures cannot run on packaging machines adjusted for those wrap-around carriers having no retention structures but retention apertures.

What is needed, therefore, is a wraparound carrier that can run on packaging machines of a basic construction that is not equipped with anchor panel folding elements.

SUMMARY OF THE INVENTION

The wrap-around carrier of the invention is comprised of side panels hingedly connected to a top panel and to bottom flaps as is well known in the art. An end retention structure is connected to at least one of the side panels and to the adjacent one of the bottom flaps. The end retention structure includes an anchor panel hingedly connected to an end edge of the one side panel and disposed in a face-contacting relationship with the inside surface of the one side panel, a gusset panel hingedly connected to the anchor panel and extending toward the adjacent end opening of the carrier, and an end panel hingedly connected to the gusset panel and disposed to engage the adjacent end article packaged in the carrier to prevent it from dislodging from the carrier. The end retention structure further includes a relief panel that hingedly interconnects the end panel with the one bottom flap. The relief panel is disposed in the plane of the one bottom flap when the carrier is in an erected condition. When the carrier is in blank form, however, the relief panel is capable of folding with respect to the one bottom flap in response to folding of the anchoring panel onto the one side panel. This arrangement allows the blank to remain in a flat collapsed condition even after the anchoring panel is brought into its folded position.

In a preferred embodiment of the invention, the bottom flaps are secured together to form a composite bottom panel.

In another preferred embodiment, the anchor panel is secured to the inside surface of the one side panel.

In still another preferred embodiment, a cutout is defined in the end retention structure to facilitate folding of the end retention structure.

In a further preferred embodiment, the cutout is defined at least in the anchor panel.

In a further preferred embodiment, the first fold line by which the relief panel is connected to the one bottom flap is disposed in alignment with the second fold line by which the gusset and anchor panels are connected together. The first angle between the first fold line and the third fold line by which the relief and end panels are connected together may be generally equal to the second angle between the second fold line and the fourth fold line by which the anchor panel and the one side panel are connected together. The second angle may be generally a half of the third angle that is defined between the fourth fold line and the fifth fold line by which the gusset panel and the end panel are connected together.

The above and other aspects and benefits of the invention will readily be apparent from the more detailed description of the preferred embodiments of the invention that follows.

DETAILED DESCRIPTION OF THE PREFERRED EMBODIMENTS

Figure 1:
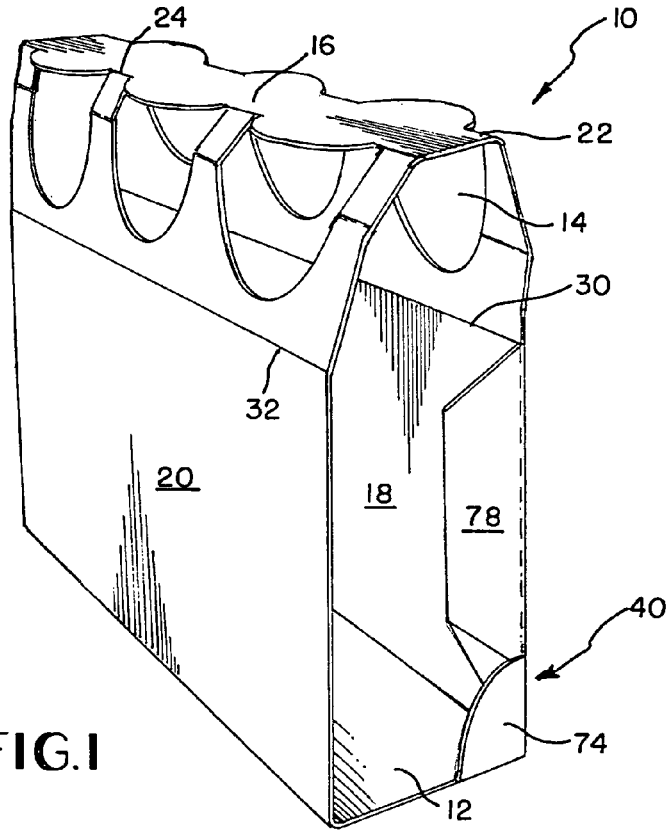
FIG. 1 is a perspective view of the carrier of the invention.
Figure 2:
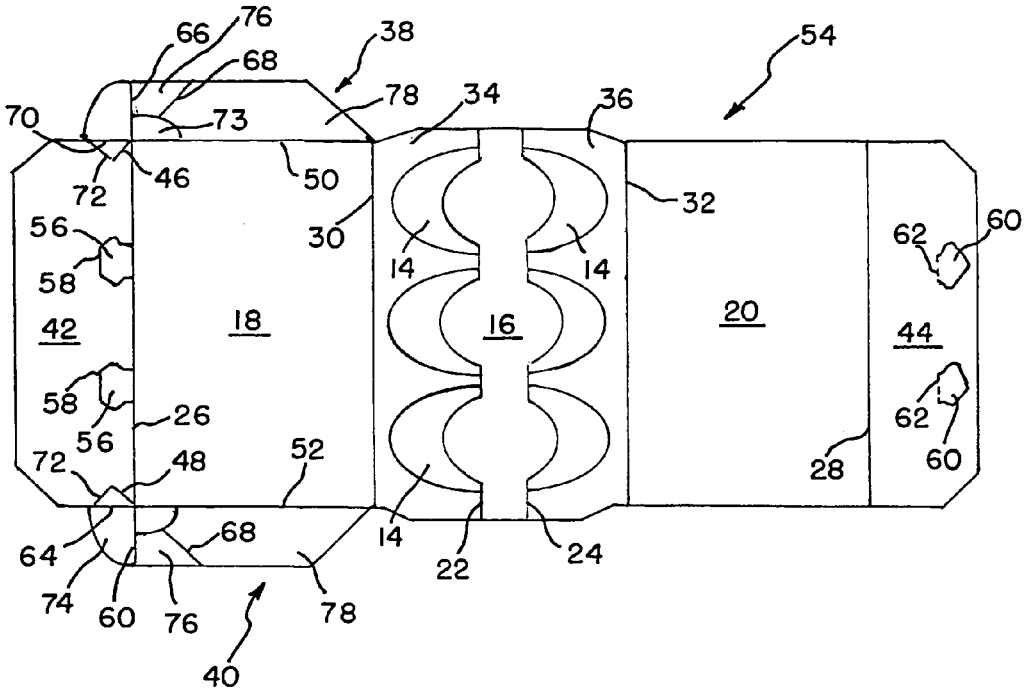
FIG. 2 is a plan view of a blank used to form the carrier in FIG. 1.

Referring to FIG. 1, the wrap-around carrier 10 is shown in an erected condition with its contents omitted for illustration purpose. The carrier 10 is designed to accommodate three bottles arranged in a row although the carrier with minor modification may package other articles such as cans, bricks, audio or video cassettes and the like. The packaged bottles should be supported on a bottom panel 12 and extend to a top panel 16 with their top portions received and exposed to view in top-receiving apertures 14 a pair of which are provided for each bottle. Opposed side panels 18 and 20 are hingedly connected to the top panel 16 along interrupted fold lines 22 and 24 respectively. The bottom panel 12 is formed of a pair of bottom lap flaps 42 and 44 as shown in FIG. 2. These lap flaps 42 and 44 are hingedly connected respectively to the side panels 18 and 20 along fold lines 26 and 28. Fold lines 30 and 32, which are parallel to and spaced a short distance from the fold lines 22 and 24, form respective upper sloped panel portions 34 and 36 of the side panels 18 and 20. The sloped panel portion 34 and 36 are formed with the aforesaid apertures 14 for receiving the top portions of the bottles to hold the bottles securely in the carrier. Although the carrier in FIG. 1 is of special significance to the packaging of bottles or other articles having straight bottom portions of an even diameter, it will be obvious from the following description that the carrier of the invention may be employed to package articles which are shaped to have angled or tapered bottom portions, often of petaloid shape. In that event, it would be necessary for the side panels 18 and 20 to be provided with lower sloped panel portions respectively. As best shown in FIG. 2, end retention structures 38 and 40 are connected to the bottom lap flap 42 along fold lines 46 and 48 and to the side panel 18 along fold lines 50 and 52. Although the carrier of FIG. 1 is provided with only one retention structure at each end of the carrier, two structures may be provided for each open end. In such a case, another pair of retention structures would be connected to the bottom lap flap 44 to the side panel 20 in a similar manner to the structures 38 and 40.

FIG. 2 shows a blank 54 of the carrier 10 in FIG. 1, wherein like reference numerals to those used in FIG. 1 denote like elements, the blank 54 include the top panel 16 connected at its opposite sides along fold lines 22 and 24 to the sloped upper panel portions 34 and 36. The top panel 16 is formed with the crescent-shaped openings 14 for receiving the top portions of bottles packaged in the carrier.

The fold lines 26 and 28 connect the side panels 18 and 20 to the bottom lap flaps 42 and 44. The bottom lap flap 42 includes female locking tabs 56 struck therefrom and hingedly connected thereto by fold lines 58. These female tabs 56 are arranged next to the fold line 26 so that each tab 56 is located in an erected carrier at a position between adjacent ones of the packaged bottles to avoid interference with the bottles. The bottom lap flap 44 includes male locking tabs 60 struck therefrom and hingedly connected thereto along fold lines 62. The male tabs 60, when the carrier is set up, are disposed in registration respectively with the female tabs 56 with the fold lines 58 aligned with the fold lines 62 and they are folded inwardly of the carrier to engage the female tabs 56. These locking tabs 56 and 60 are illustrated to demonstrate a typical bottom lap flap locking arrangement suitable for use with the carrier of the invention, but it should be understood that any desired effective form of bottom lap flap locking means may be employed. For example, the locking tabs 56 and 60 may be replaced by those disclosed in U.S. Pat. Nos. 4,077,095 ; 4,243,143 ; 5,131,588; or 4,243,043 which are hereby incorporated by reference. Otherwise, the bottom lap flaps 42 and 44 may be glued together.

Figure 3:
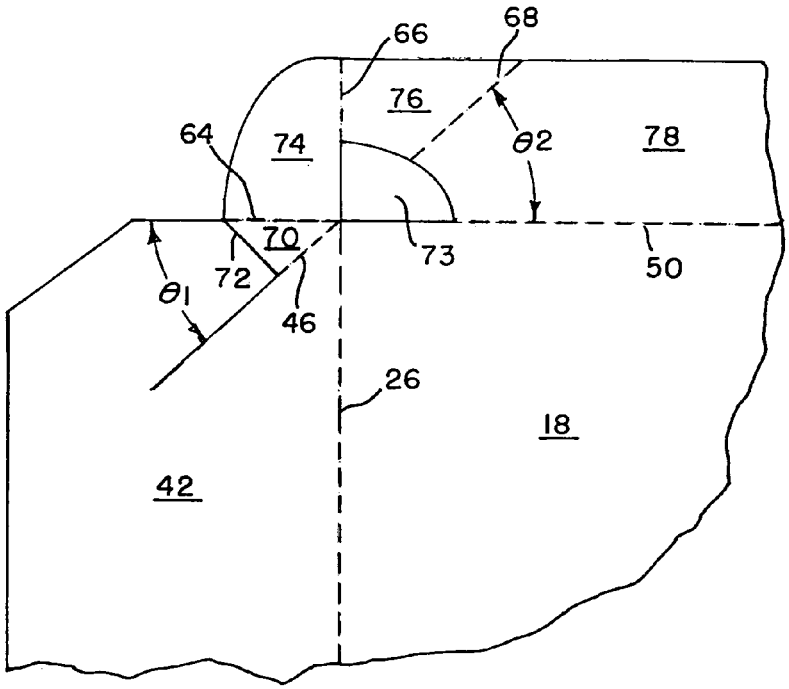
FIG. 3 is an enlarged fragmentary view of the blank in FIG. 2.

Referring further to FIG. 2, the retention structures 38 and 40 are of virtually the same construction. Therefore, only the retention structure 38 is described herein below and the description of the structure 40 is omitted. However, the construction of the retention structure 40 should be apparent from FIG. 2 as like reference numerals to those used for the structure 38 denote like elements of the retention structure 40. The end retention structure 38 includes three intermediate fold lines 64, 66 and 68 which divide the structure 38 into four panel sections 70, 74, 76 and 78 hingedly connected one to next. The fold line 64 is aligned with the fold line 50 by which the retention structure 38 is connected to the side panel 18. The fold line 64 extends from the outer edge of the retention structure 38 to a cutout 73 that is defined in the structure 38. This divides the first section or triangular relief panel 70 from the remainder of the structure 38. The relief panel 70, in fact, is formed from the bottom lap flap 42 by means of a cut 72 that extends from the fold line 46 to the outer edge of the bottom lap flap 42. The relief panel 70 is thus bounded by the cut 72 and the fold lines 46 and 64. The fold line 66 is aligned with the fold line 26 by which the bottom lap flap 42 is connected to the side panel 18. The fold line 66 extends from the outer edge of the retention structure 38 to the cutout 73 and thereby divides, in cooperation with the fold line 64, the second panel section or end panel 74 from the remainder of the structure 38. Similarly, the fold line 68 extends from the outer edge of the retention structure 38 to the cutout 73, dividing the further remainder of the retention structure 38 into the third and fourth panel sections, i.e., a gusset panel 76 and an anchor panel 78. The gusset panel 76 is hingedly connected to the end panel 74 along the fold line 66 while the anchor panel 78 hingedly interconnects the gusset panel 76 and the side panel 18. In other words, the anchor panel 78 is one of the opposite end sections of the retention structure 38 that is directly connected to the side panel 18 along the fold line 50. The other end section is the relief panel 70 that is directly connected to the bottom lap flap 42 along the fold line 46. The fold line 46 is aligned with the fold line 68 and disposed at angle θ1 (shown in FIG. 3) with respect to the fold line 64. Angle θ1 is generally equal to Angle θ2 (shown in FIG. 3) between the fold lines 50 and 68. Angle θ2 typically is a half of the angle between the fold lines 50 and 66. Each of Angles θ1 and θ2 is about 45 degrees in this embodiment. However, these angles may vary depending on the panel arrangement in the blank.

Turning to the construction of the carrier of the present invention, it is envisaged that it can be formed by a series of sequential folding and gluing operations in a straight line machine so that the carrier is not required to be rotated or inverted to complete its construction. The folding process is not limited to that described below and may be altered according to particular manufacturing requirements.

Figure 4:
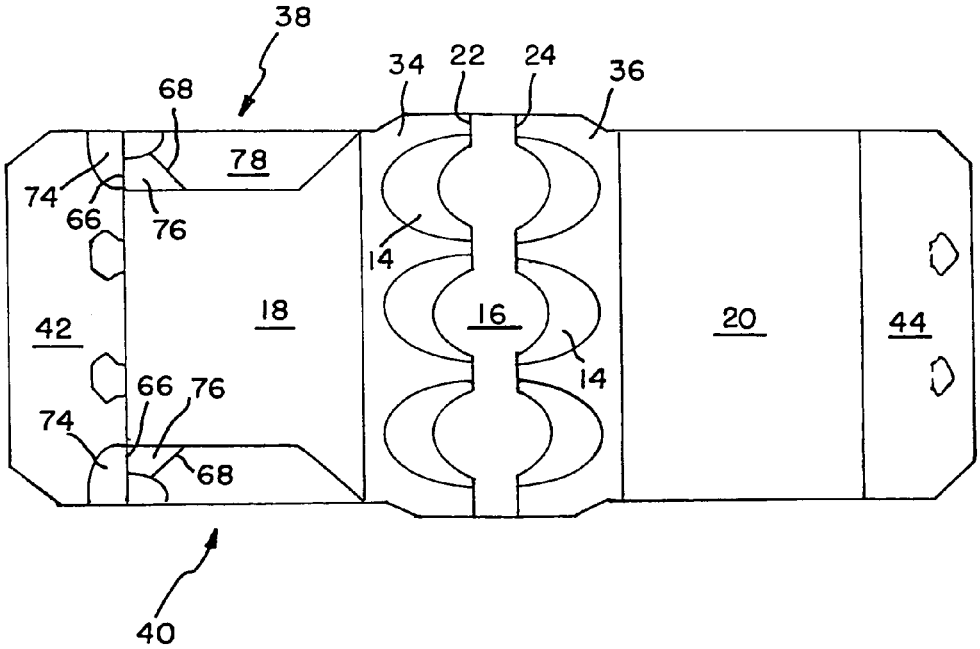
FIG. 4 is a plan view of the blank in an initial stage of end retention structure pre-folding process.
Figure 5:
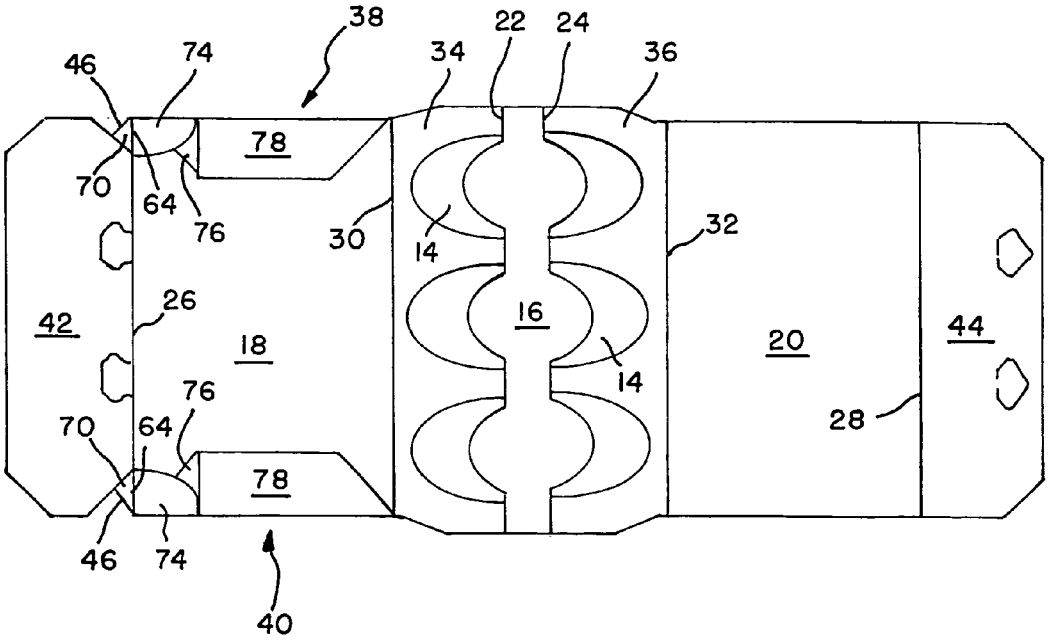
FIG. 5 is a plan view similar to that of FIG. 4, but showing the end panels being folded flat on the gusset panels.

FIGS. 4 and 5 illustrate the retention structure pre-folding process. The first step is for the second to fourth panel sections 74, 76 and 78 of each retention structure to be folded along the fold lines 50 and 64 so as to bring the anchor panel 78 into face-contacting relationship with the inside surface of the side panel 18. This is best shown in FIG. 4. The anchor panel 78, preferably, is glued to the side panel to be held in the folded position. Then, the gusset panel 76 is folded back along the fold line 68 onto the anchor panel 78 while the end panel 74 is folded inwardly along the fold line 66 to be placed over the gusset panel 76. This is best shown in FIG. 5. In response to the folding of the end and gusset panels 74 and 76, the relief panel 70 swings about the fold line 46 toward the gusset panel 76 and places itself on the inside surface of the bottom lap flap 42. This swinging movement of the relief panel 70 prevents the bottom lap flap 42 from being pulled or folded toward the side panel 18, and thereby allows the blank 54 to remain flat as shown in FIG. 5. The carrier is now in a part-constructed condition with the retention structures pre-folded, but in a flat collapsed condition ready to be supplied to the end user.

Figure 6:
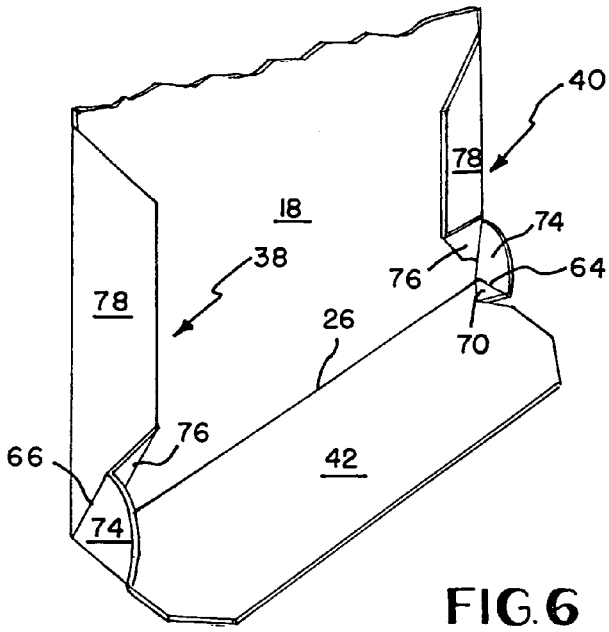
FIG. 6 is a perspective view of the interior face of one of the side panels, showing the interim condition where the end panels are automatically erected in response to the inward folding of the associated bottom lap panel.

In order to erect the article carrier, the top panel 16 is applied to the tops of bottles arranged in a row to be packaged by the carrier. The side panels 18 and 20 are folded downwardly along the fold lines 22 and 24, and the upper sloped panel portions 34 and 36 are folded out of alignment with the remainder of the side panels 18 and 20 along the fold lines 30 and 32 so as to be disposed in a flanking relationship with the side walls of the bottles. The top portion of the bottles are received in the opening 14 and thereby retained in their positions. Before the side panels 18 and 20 are brought into contact with the side walls of the bottles, the bottom lap flaps 42 and 44 are folded along the fold lines 26 and 28 toward each other. This movement activates the relief panels 70 to unfold the end panels 74 outwardly along the fold lines 66 to bring them into their erected position. More particularly, the relief panels 70 are automatically unfolded along the fold lines 46 toward their initial positions when the bottom lap panels 42 and 44 are folded along the fold lines 26 and 28. This, in turn, causes the end panels 74 to be folded out of alignment with their associated relief panels 70 along the fold lines 64 and to be pushed outwardly away from each other. This interim condition is shown in FIG. 6, where the bottom lap flap 42 is folded somewhat with respect to the side panel 18 but is still at an obtuse angle with respect to the side panel 18. Thus, by the time the bottom lap flap 42 is positioned at 90 degrees with respect to the side panel 18, the relief panels 70 are brought back to their initial positions where they lie in the plane of the bottom lap flap 42, and the end panels 74 are brought to erected positions where they lie perpendicular to the fold line 26. During or after this end panel-erecting process, the side panels 18 and 20 are brought into contact with the bottles so that the bottom portions of the opposite end bottles are snugly received in the respective corners between the end and gusset panels 74 and 76. At the same time, the bottom lap flaps are moved into an overlapping relationship.

The final step in the erection of the carrier is to lock the bottom lap panels 42 and 44 together. The details of this phase of the operation have not been illustrated since the particular locking mechanism employed does not form part of the invention. It will, however, be understood by those familiar with the locking elements shown that the male tabs 62 are folded about the fold lines 62 into the apertures defined in the bottom lap flap 42 by the female tabs 56 and are engaged with the perimeter of the such apertures. Locking of the tabs 56 and 60 results in the carrier in a set up condition as shown in FIG. 1. In the carrier of this embodiment, the pre-glued anchor panels 78 maintain the end panels in the erected positions. However, the same result would be available in the arrangement where the anchor panels are not glued to the side panel. Even in such an event, the pressure of the end bottles against the anchor panels 78 holds the anchor panels in position, and thus the end panels 74 would still be held in their erected positions.

Figure 7:
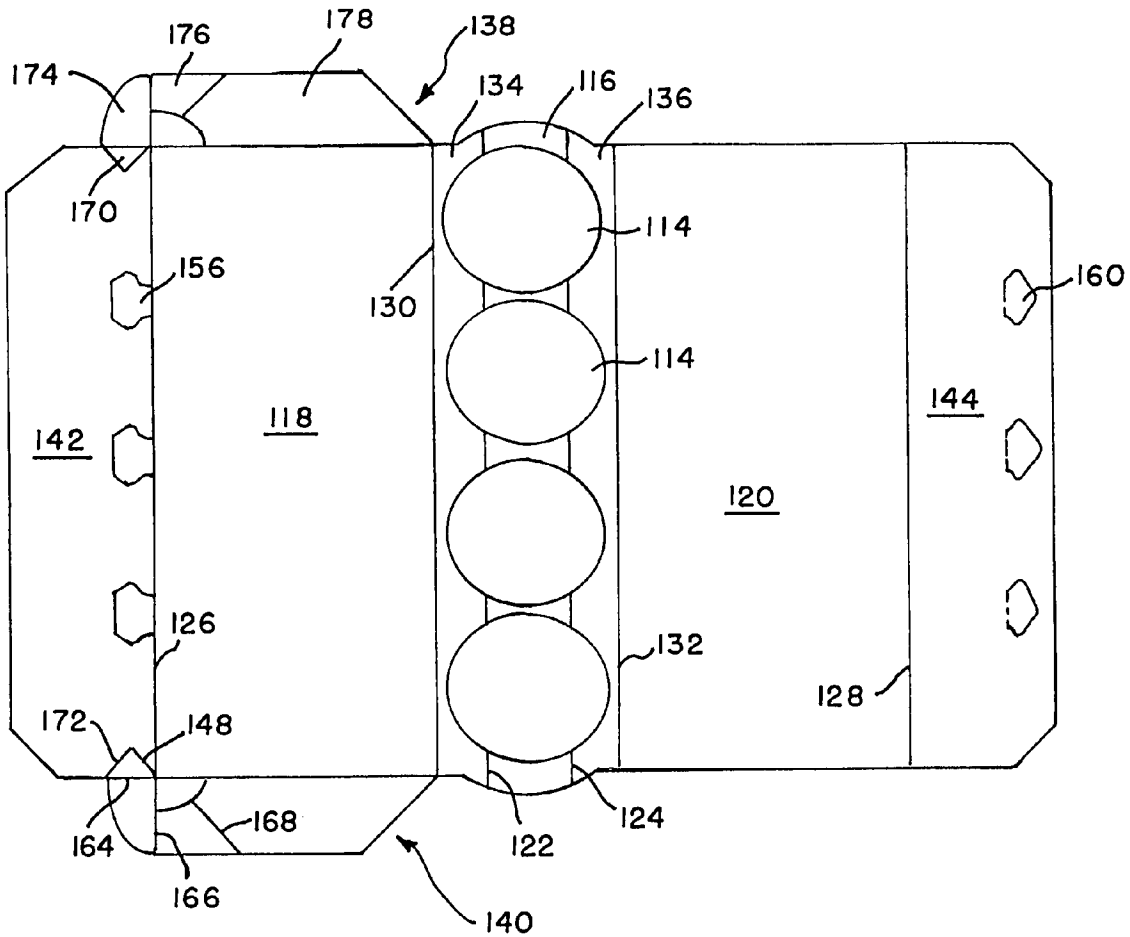
FIG. 7 is a plan view of a blank for the carrier of alternative embodiment.

Although the invention has been described in connection with a carrier designed to hold three bottles, it may be incorporated into carriers designed to hold more or less than that and can be utilized with articles of various sizes and shapes. For example, if the articles to be packaged have necks or are otherwise shaped so as to extend through the top panel, the openings 14 of each pair in FIG. 2 may be replaced by a single larger opening through which the bottle neck or a similar portion may be outwardly protruded. Such an alternative embodiment is shown in blank form in FIG. 7 wherein like reference numerals to those used in FIG. 2 have been used with the prefix "1" to denote like elements. Regardless of the specific design of the carrier, the principles of the invention would remain the same, with the retention structures being automatically moved into their final erected positions by the folding of the bottom lap panel.

It will also be recognized that as used herein, the terms "top", "bottom" and "side" with respect to the panels of the carrier or carrier blank are relative terms, and that the carrier may be re-oriented as necessary or as desired.

The invention claimed is:

1. A wrap-around carrier comprising:

a top panel;

a pair of opposed side panels hingedly connected to said top panel;

a pair of bottom flaps hingedly connected to said side panels respectively; and an end retention structure connected to at least one of said side panels and to an adjacent one of said bottom flaps, said end retention structure including an anchor panel hingedly connected to an end edge of said one side panel and disposed in a face-contacting relationship with an inside surface of said one side panel, a gusset panel hingedly connected to said anchor panel and extending toward an adjacent end opening of said carrier, an end panel hingedly connected to said gusset panel and disposed to engage an adjacent end article packaged in said carrier to prevent the end article from dislodging from said carrier, and a relief panel hingedly interconnecting said end panel with said adjacent bottom flap, said relief panel being disposed in a plane of said adjacent bottom flap when said carrier is in an erected condition and being folded out of said plane in response to folding of said anchoring panel and said gusset panel onto said one side panel and said anchoring panel respectively when said carrier is in blank form.

2. The carrier according to claim 1 wherein said bottom flaps are secured together to form a composite bottom panel.

3. The carrier according to claim 1 wherein said anchor panel is secured to said inside surface of said one side panel.

4. The carrier according to claim 1 wherein a cutout is defined in said end retention structure to facilitate folding of said end retention structure.

5. The carrier according to claim 4 wherein said cutout is defined at least in said anchor panel.

6. The carrier according to claim 1 wherein said relief panel is connected to said one bottom flap along a first fold line, said gusset panel and said anchor panel are connected together along a second fold line, and said first fold line is disposed in alignment with said second fold line.

7. The carrier according to claim 6 wherein said relief panel and said end panel are connected together along a third fold line, said anchor panel and said one side panel are connected together along a fourth fold line, said first and third fold lines are disposed to define a first angle therebetween, and said first angle is generally equal to a second angle defined between said second fold line and said fourth fold line.

8. The carrier according to claim 7 wherein said gusset panel and said end panel are connected together along a fifth fold line, and said second angle is generally a half of a third angle that is defined between said fourth and fifth fold line.

* * * * *